US005664590A

United States Patent [19]

Plateroti et al.

[11] Patent Number: 5,664,590

[45] Date of Patent: Sep. 9, 1997

[54] HAIR FROSTING OR COLOR DEVICE AND METHOD

[76] Inventors: Rocky Plateroti, 3320 Chelsey St., Mohegan Lake, N.Y. 10547; Franco Marino, 11 Academy St., Pleasantville, N.Y. 10570

[21] Appl. No.: 526,668

[22] Filed: Sep. 11, 1995

[51] Int. Cl.[6] ..... A45D 19/18

[52] U.S. Cl. ..... 132/270; 132/207; 132/208; 132/212; 132/902

[58] Field of Search ..... 132/270, 207, 132/208, 212, 319, 902

[56] References Cited

U.S. PATENT DOCUMENTS

| | | | |
|---|---|---|---|
| 3,618,620 | 11/1971 | Williams | 132/212 |
| 3,692,032 | 9/1972 | Regas | 132/270 |
| 3,861,405 | 1/1975 | Pellecchia | 132/270 |
| 3,921,647 | 11/1975 | Fisher | 132/270 |
| 3,941,613 | 3/1976 | Nicoletti | 132/270 |
| 4,196,741 | 4/1980 | Minghenelli | 132/270 |
| 4,552,159 | 11/1985 | Fabbri et al. | 132/207 |
| 4,637,411 | 1/1987 | Sanders | 132/212 |
| 4,672,983 | 6/1987 | Nath et al. | 132/208 |
| 5,042,514 | 8/1991 | Bastien | 132/270 |
| 5,056,538 | 10/1991 | Matula | 132/208 |
| 5,056,539 | 10/1991 | Abramson | 132/270 |
| 5,058,609 | 10/1991 | Sandoz et al. | 132/270 |
| 5,287,864 | 2/1994 | Gallo | 132/208 |
| 5,433,232 | 7/1995 | Garrett | 134/111 |
| 5,469,873 | 11/1995 | Guth | 132/270 |
| 5,535,764 | 7/1996 | Abramson | 132/270 |

*Primary Examiner*—Gene Mancene
*Assistant Examiner*—Pedro Philogene

[57] ABSTRACT

A device for coloring hair to obtain highlighted sections is provided. It has lower rectangular layer of flexible material having the upper surface provided with hook fasteners to hold hair strands in place and to cooperate with an intermediate matching rectangular layer with a pattern through it. The lower surface of the intermediate layer has loop fasteners adapted to cooperate with the hook fasteners on the lower layer. An upper layer of matching rectangular, clean, flexible plastic material is provided. The lower, intermediate, and upper layers being secured together along one edge.

1 Claim, 5 Drawing Sheets

HAIR FROSTING OR COLOR DEVICE AND METHOD

BACKGROUND OF THE INVENTION

1. Field of the Invention

This invention relates to a hair frosting and coloring device and method of using the device. In particular this invention is concerned with providing hair coloring or streaking in a highlighted pattern or style. In other words, the hair is not colored uniformly but certain sections or strands or parts thereof are highlighted with one color or bleached and other portions are either untreated or treated differently.

The process in the past has comprised combing out a section of hair, placing it on adhesive surface and thereafter painting or streaking the hair strands in that layer and rolling up the foil or adhesive paper, securing it, and then taking a second piece and doing the same.

One inherent problem is that there is no pattern guide and it is often left to the devices of the individual operator as to how the coloring or bleaching material is applied.

The current invention provides a basis for placing the layer of strands of hair to be treated on a underlying surface contained within Velcro® fabric and an overlying Velcro stencil which can be cut out appropriately with various different patterns and readily secured to the underlying base sheet, and covered with an overlayer. Thus, a convenient way of holding the hair is provided as well as various overlying patterns to provide guidance to an operator who may be relatively inexperienced with this type of procedure and yet is able to accomplish a satisfactory treatment with little or no training, except following package directions.

2. Prior Art

Various methods of utilizing a coloring agent which is simply painted onto a subject's hair which limits the control. This method lacks accurate control of which strands of hair to color and which are not and allows the agent to run and damage the scalp.

Other methods utilized include covering the subject's head with a cap having a plurality of holes through which strands of hair are pulled. The coloring agent is then applied to those strands. This is a very time consuming labor intensive effort, uncomfortable for the person receiving the treatment, and lacks any pattern and reproducability. Another common method is utilization of foil wherein the hair is separated in strands which are placed on a small foil, coloring agent applied to the hair, and then the foil folded to enclose and encase the hair treated.

U.S. Pat. No. 3,433,232 Garrett discloses a process for applying designs to the surface of the hair which comprises applying a lacquer spray on a target area of the coiffeur head. It includes an adhesive film that bonds adjacent side by side strands of hair together, thereafter superimposing sheets stenciled with a selected design on a prepared foundation and pressing it against the foundation to retain itself adhesively thereon and directing a spray of colorful lacquer on the foundation through the apertures of the stencil thus applying a color pattern to the lacquered foundation, and thereafter removing the stencil to display the design. Thus, you are essentially gluing the surfaces of adjacent hairs together with an adhesive lacquer, placing a stencil, over it, and spraying the matted surface of the hair, rather than dying individual hairs in a pattern.

U.S. Pat. No. 4,196,741 Minghenelli discloses a product and process for highlighting and streaking hair which is very similar to the foil method in commercial usage mentioned above. In this case the adhesive is along only one edge of the foil sheet.

U.S. Pat. No. 5,287,864 Gallo, a further variation is disclosed in which a slot is provided for a tail of a tail comb in a sleeve of the foil sheet so that the stylist can pick up and properly place the foil at a strand of hair to be treated.

U.S. Pat. No. 3,941,613 Nicolettti discloses a hair frosting device comprising a container having a hinge at one end, which can be opened and hair placed therein. Hair can then be treated, and the container can be snapped closed while the hair is treated. The cap has a number of small apertures for pulling the hair through.

U.S. Pat. No. 3,618,620 Williams discloses a hair curler and frosting tool having a circular base member with a spindle extending therefrom. Received on the spindle is a cage having a circular top. The apparatus may be used to bleach or to color and curl hair.

U.S. Pat. No. 5,058,609 Sandoz et al. discloses a hair highlighting apparatus comprising a flexible liquid impermeable sheet, and a textile sheet adhered thereto. The textile sheet includes on its outer surface self-adhesive material. The sheet is placed about the hair to be treated, a treating solution is placed on the hair, and the sheet is folded over to cover the hair being treated.

U.S. Pat. No. 5,056,539 Abramson discloses a product for highlighting hair comprising a segment of aluminum foil with windows of transparent material which allow the effect of the coloring agent or bleaching agent to be viewed from the exterior of the foil. Additionally, the foil contains a strip of adhesive for holding the ends of the foil together about a strand of hair.

U.S. Pat. No. 3,921,647 Fisher discloses an apparatus for isolating and chemically treating selected bundles of hair comprising a clamp having a platform and a clip. The platform includes a pair of jaws that grab, position and hold hair to isolate selected hair from the remainder of the hair so that the selected hair may be processed.

The following patents are included as general background information showing other devices and processes for applying color to selected portions of a head of hair.

U.S. Pat. No. 3,861,405 Pellecchia; U.S. Pat. No. 5,042,514 Bastien U.S. Pat. No. 5,056,538 Matula; U.S. Pat. No. 4,672,983 Nath et al

SUMMARY OF THE INVENTION

In accordance with the invention there has been provided a convenient operating device for facilitating the patterns for streaking, highlighting or dyeing selected sections of hair strands for frosting or dyeing with a convenient and generally reproducible method. Most importantly different colors may be applied within the same section without bleeding or running off of color.

The device of the present invention consists of a first layer of liquid impermeable material which is flexible and on its upper side is provided with a nylon hook fastener surface.

The lower edge of the first lower layer is secured to an intermediate layer, also made of flexible material whose lower face has a nylon loops fastener surface thereon and is in the form of a stencil which is patterned with designs cut through it to provide openings of selected patterns. This is layed over the selected strands of hair positioned on the underlying layer. The final layer is a clear that is transparent flexible material to separate hair on next section and to view the color development. The three layers are secured together at their base.

In utilizing this device, the selected strands of hair are layered across the first layer of material and are held in place there by the nylon fastener hooks, available under the brand name Velcro and others. The patterned layer is placed over it and a brush, sponge, or other applicator used to apply frosting or closed over and then device simply can be hung or folded over as in prior applications. The advantage here is that the patterns are reproducible and the device can be cleansed after utilization and reused for a different application on a different person or stored for utilization by the particular patron.

BRIEF DESCRIPTION OF THE DRAWING

In the accompanying drawing which forms a part of the specification.

ILLUSTRATIVE SPECIFIC EMBODIMENT

Figure 1:
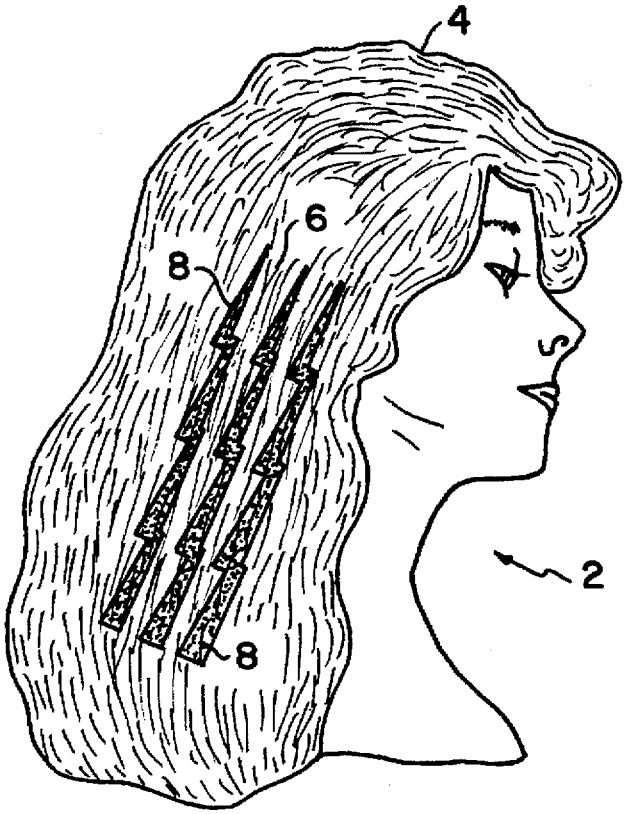
FIG. 1 is a perspective view of an individual's head and hair, with the hair being streaked using the device of the present invention.

A person 2 with hair 4 treated according to the present invention is shown in FIG. 1 of the accompanying drawings.

A section 6 of the hair 4 has been highlighted using the device 10 of the present invention. A jagged streaked pattern 8 has been applied. It is understood the pattern 8 shown is an extreme for illustrative purposes only. In actual practice it would generally appear more subdued.

Figure 2:
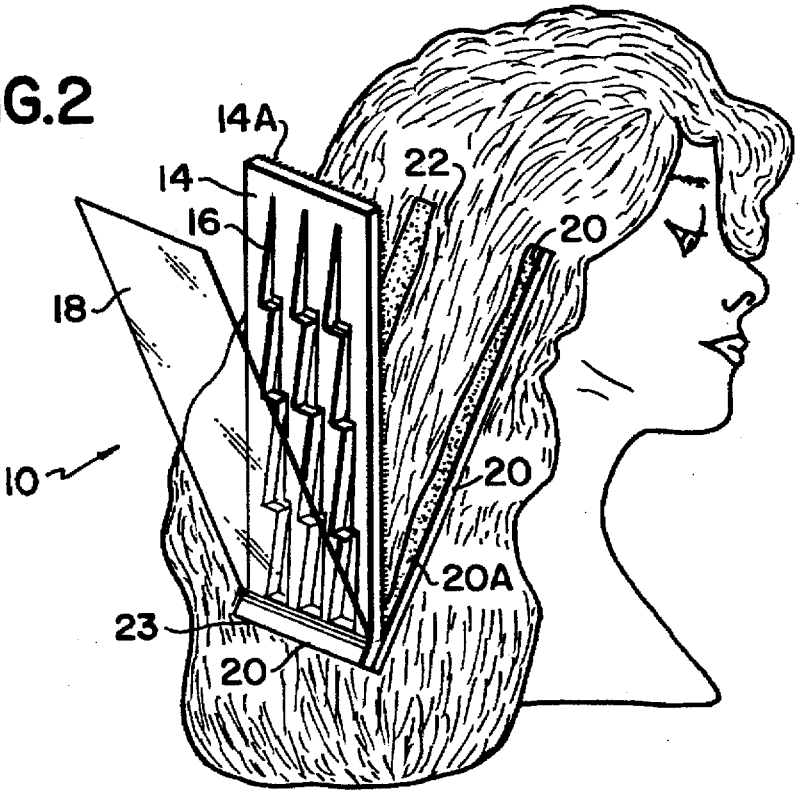
FIG. 2 is the perspective view of the device of the present invention being set in place on a section of hair to be treated showing the primary components of the device.

The device 10 of the present invention is shown being utilized on strands 22 of hair 4 in FIG. 2. A base layer 20 is layed under the strands of hair 22. An overlaying layer 14, having patterns 16 a cover cut in it is next overlaid. The outer layer 18 is a clear vinyl plastic which closes down over layers 20 and 14 to keep the coloring fluids from draining out and allow a view of the color development. The layers 14, 20, and 18 are all secured together by a suitable adhesive, stitching, or the like at the base edge 23. The nylon hook fasteners are represented as 20A and the loops 14A.

Figure 3:
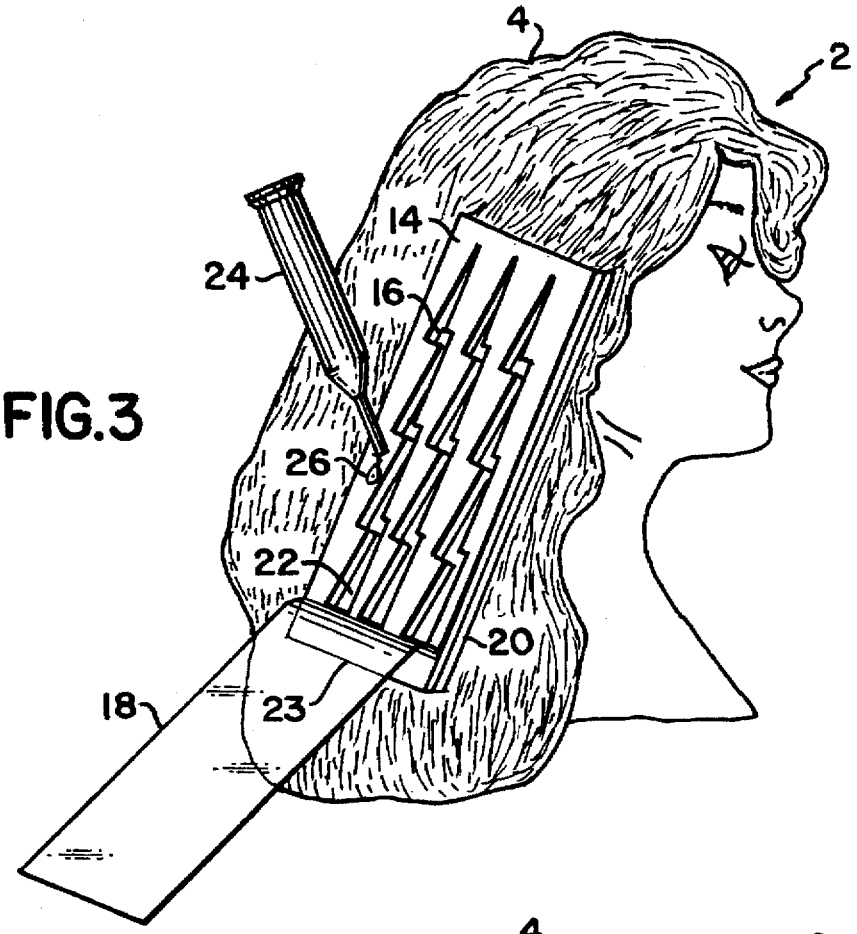
FIG. 3 is a similar view showing a device in place on the selected portion of hair with one or multiple dye applicators or brushes utilized to apply dye or streaking compound to selected portions of the hair.
Figure 4:
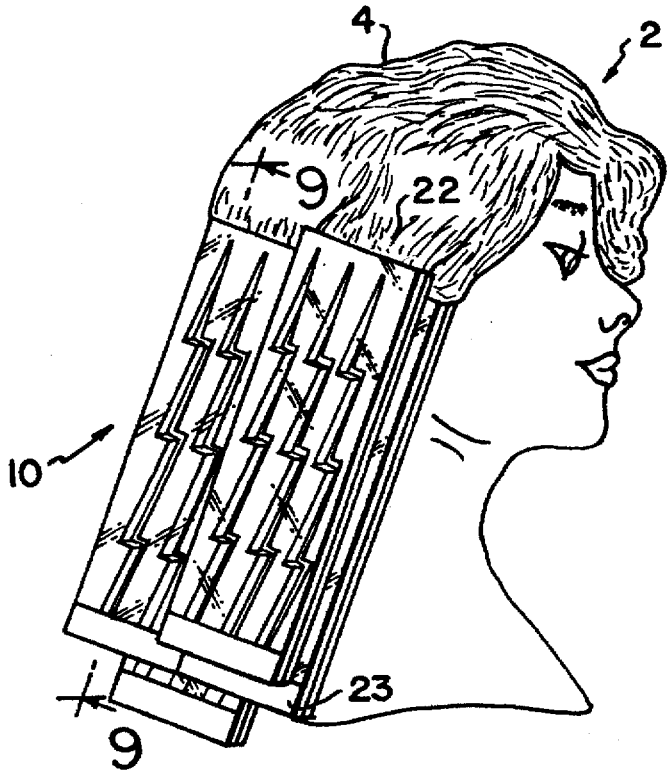
FIG. 4 shows a number of the devices rolled up after application of a hair color compound to selected portions of the hair.
Figure 5:
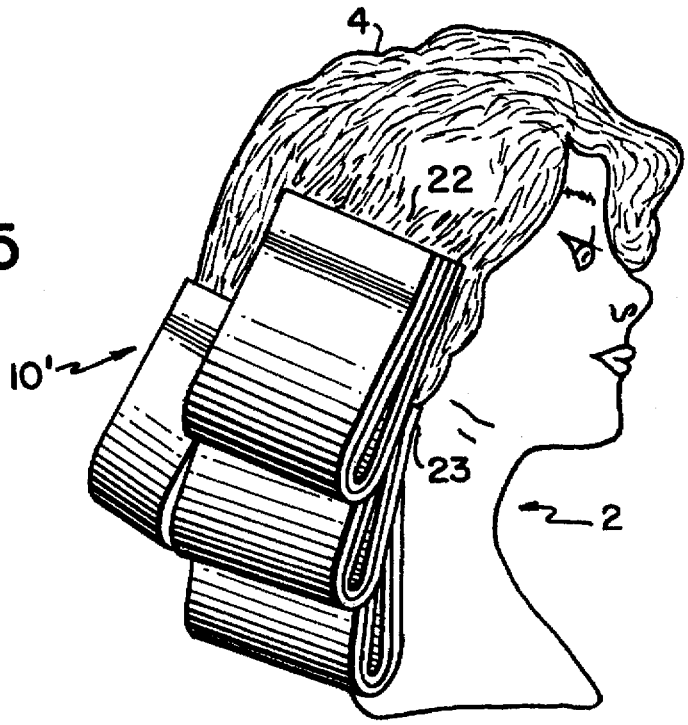
FIG. 5 is a similar view, with multiple devices folded over.

In FIG. 3 the intermediate layer 14 has been closed down over the strands 22 of hair 4, and an applicator 24 with appropriate highlighting fluid compound, or fluid colorant is utilized to place or brush drops 26 of the fluid through the pattern 16 onto the strands 22 of hair 4 to be treated. Thereafter, the cover layer 14 is folded over and the individual device 10 folded up as shown FIG. 4.

Figure 6:
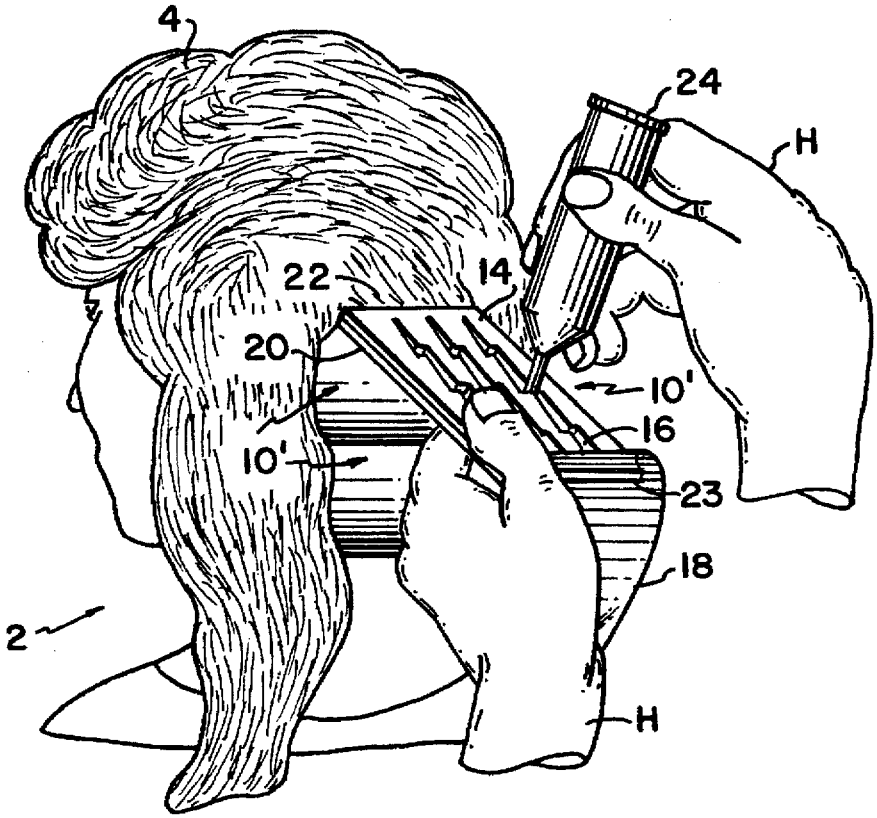
FIG. 6 shows the application on another portion of the hair.
Figures 7, 8:
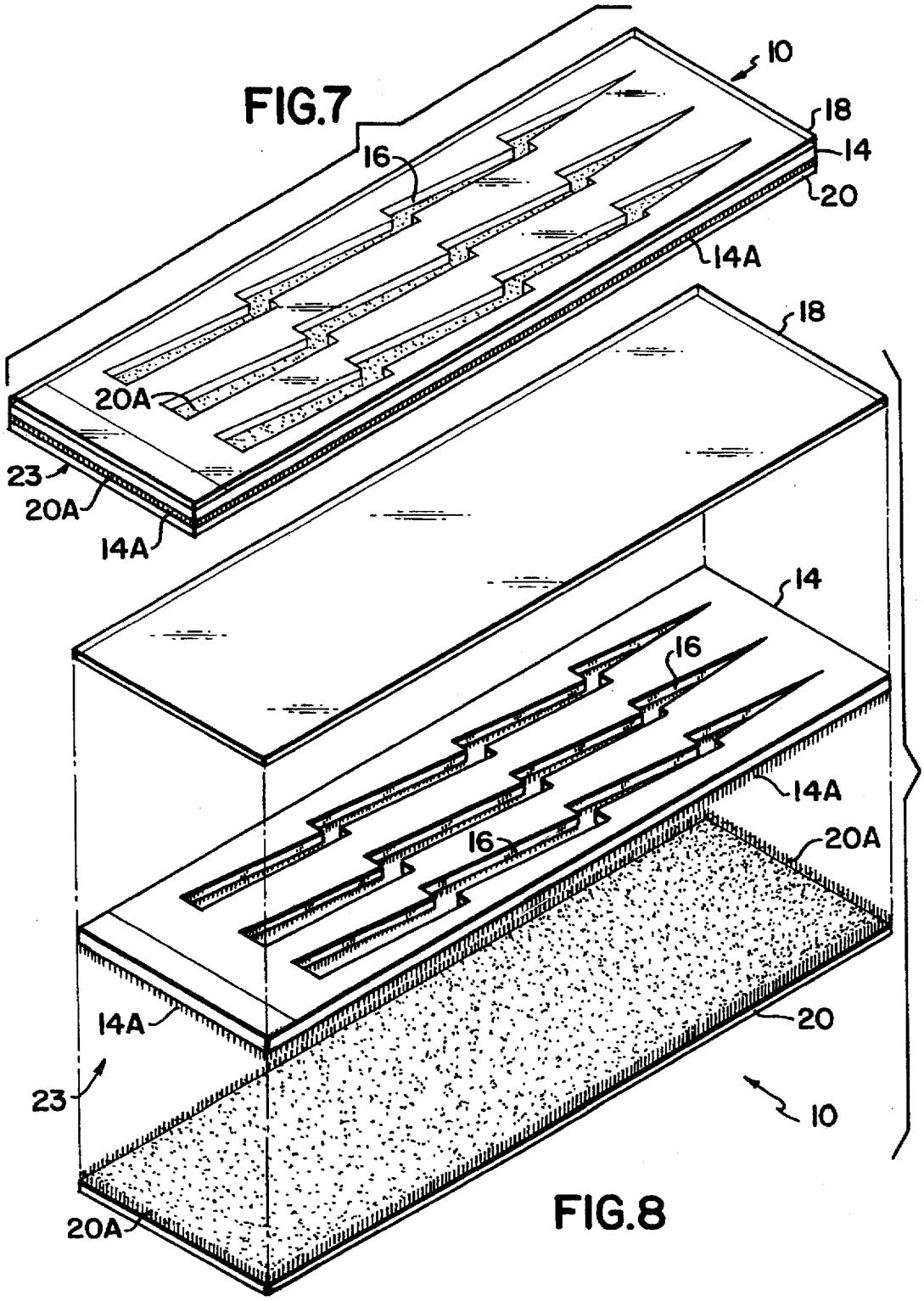
FIG. 7 is a isolated perspective view the device of the present invention.
FIG. 8 is an expanded view of the device shown in FIG. 7 illustrating the component parts.

The application steps are repeated. The operator works around the head 3 of the person 2 as shown in FIG. 6.

Figure 9:
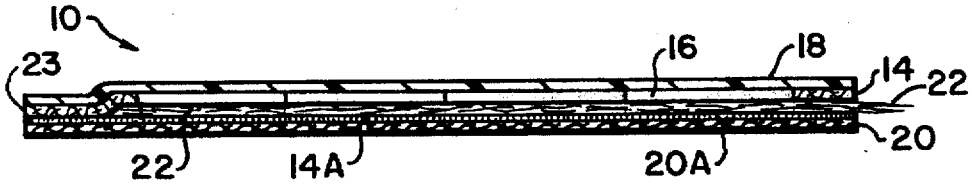
FIG. 9 is a side sectional view of the device and showing the placement of selected strands of hair within the device.

A cross-section of the device 10 is shown in FIG. 9. The base layer 20 has Velcro hooks 20A on its upper surface. The strands of hair 22 are placed on base layer 20, the stencil layer 14 with Velcro loops 14A next, the hooks 20A and loop 14A engaging, and then the layer 18 of clear plastic on top.

Figure 10:
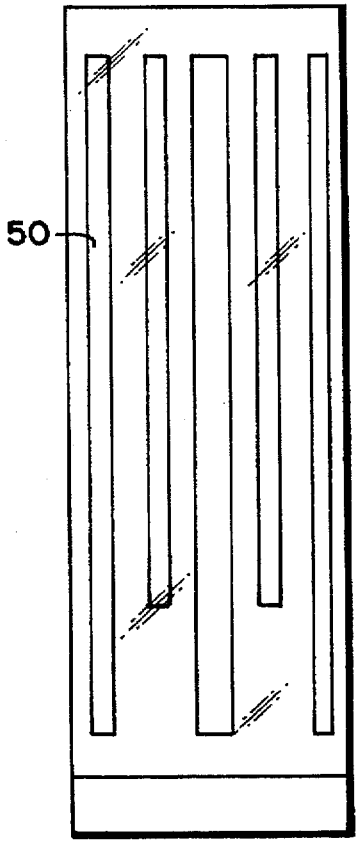
FIG. 10 is an example of the device with different patterns.
Figure 11:
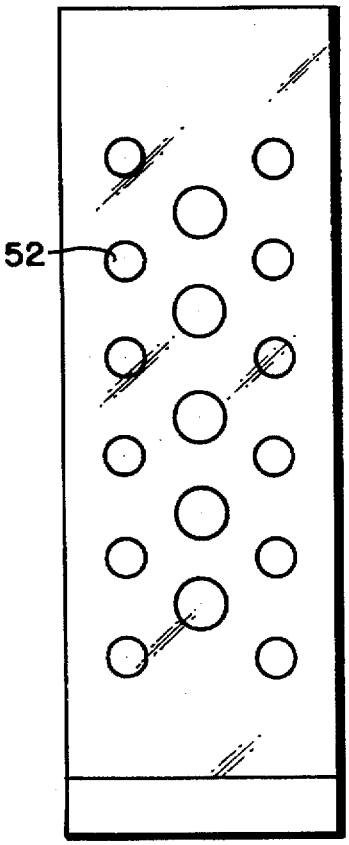
FIG. 11 is further variation of patterns.
Figure 12:
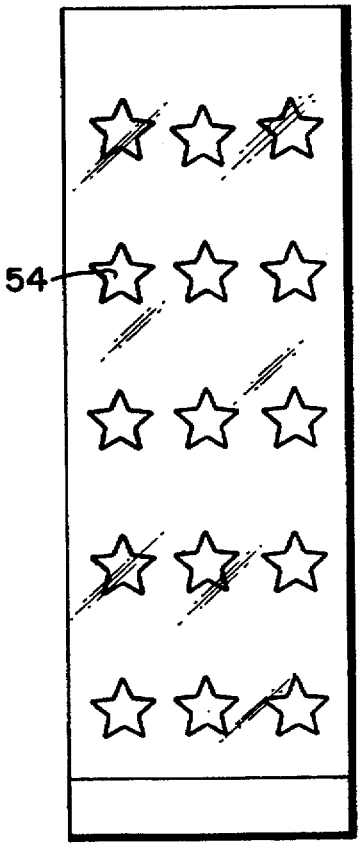
FIG. 12 is an additional variation of possible patterns possible.

FIG. 10, 11, and 12 of the illustrations show various different patterns which can be utilized, of course it is understood that a infinite number of patterns can be utilized.

The solid portion in each case is indicated at 30 with the cutouts indicated as 50, 52, and 54 respectively. Stripes 50 are utilized in FIG. 10. A pattern of circles 52 in FIG. 11, and a pattern of stars 54 in FIG. 12.

While invention has been described by reference to an illustrative embodiment, it is not intended that the novel device be limited thereby, but that modifications thereof are intended to be included as falling within the broad spirit and scope of the foregoing disclosure, the following claims and the appended drawings.

What is claimed is:

1. A device for use in the color treating of hair comprising: a lower rectangular layer of flexible material having an upper surface of hook fasteners to hold hair strands in place and to cooperate with top fasteners, an intermediate rectangular layer having a pattern therethrough and the lower surface thereof having loop fasteners thereon adapted to cooperate with said hook fasteners; an upper layer of rectangular clear flexible plastic sheet; said lower, intermediate, and upper layers secured together along one edge portion.

* * * * *